US008960282B2

(12) United States Patent
Zhu

(10) Patent No.: US 8,960,282 B2
(45) Date of Patent: Feb. 24, 2015

(54) CENTRIFUGAL SUBTERRANEAN DEBRIS COLLECTOR

(75) Inventor: Hong Zhu, Katy, TX (US)

(73) Assignee: Baker Hughes Incorporated, Houston, TX (US)

( * ) Notice: Subject to any disclaimer, the term of this patent is extended or adjusted under 35 U.S.C. 154(b) by 439 days.

(21) Appl. No.: 13/098,166

(22) Filed: Apr. 29, 2011

(65) Prior Publication Data

US 2012/0273278 A1 Nov. 1, 2012

(51) Int. Cl.

*E21B 43/00* (2006.01)
*E21B 27/00* (2006.01)
*E21B 37/00* (2006.01)

(52) U.S. Cl.

CPC ..... *E21B 27/00* (2013.01); *E21B 37/00* (2013.01)
USPC ..... 166/265; 166/107; 166/105.1; 166/311; 166/99; 210/787

(58) Field of Classification Search

CPC ..... E21B 27/00; E21B 43/121; E21B 43/38; E21B 27/005; E21B 43/34
See application file for complete search history.

(56) References Cited

U.S. PATENT DOCUMENTS

| | | | | |
|---|---|---|---|---|
| 4,276,931 | A | 7/1981 | Murray | |
| 4,924,940 | A | 5/1990 | Burroughs et al. | |
| 5,123,489 | A | 6/1992 | Davis et al. | |
| 5,295,537 | A * | 3/1994 | Trainer | 166/105.1 |
| 5,662,167 | A * | 9/1997 | Patterson et al. | 166/265 |
| 6,170,577 | B1 | 1/2001 | Noles, Jr. et al. | |
| 6,176,311 | B1 | 1/2001 | Ryan | |
| 6,189,617 | B1 | 2/2001 | Sorhus et al. | |
| 6,250,387 | B1 | 6/2001 | Carmichael et al. | |
| 6,276,452 | B1 | 8/2001 | Davis et al. | |
| 6,382,317 | B1 | 5/2002 | Cobb | |
| 6,607,031 | B2 | 8/2003 | Lynde et al. | |
| 6,698,521 | B2 * | 3/2004 | Schrenkel et al. | 166/369 |
| 6,978,841 | B2 | 12/2005 | Hoffman et al. | |
| 7,472,745 | B2 * | 1/2009 | Lynde et al. | 166/99 |
| 7,478,687 | B2 | 1/2009 | Lynde et al. | |
| 7,610,957 | B2 | 11/2009 | Davis et al. | |
| 7,635,430 | B2 | 12/2009 | Mildren et al. | |
| 7,779,901 | B2 | 8/2010 | Davis et al. | |
| 2001/0013413 | A1 | 8/2001 | Ruttley | |
| 2002/0074269 | A1 | 6/2002 | Hensley et al. | |

OTHER PUBLICATIONS

Connell, P., et al., "Removal of Debris From Deepwater Wellbores Using Vectored Annulus Cleaning System Reduces Problems and Saves Rig Time", SPE 96440, Oct. 2006, 1-6.

* cited by examiner

*Primary Examiner* — Jennifer H Gay
*Assistant Examiner* — Caroline Butcher
(74) *Attorney, Agent, or Firm* — Steve Rosenblatt

(57) ABSTRACT

A subterranean debris catcher takes in debris laden fluid at a lower end. The inlet flow is induced with an eductor whose discharge goes around the housing to the lower end inlet for the debris. The eductor suction induces flow into the lower end of the housing as well. Incoming debris goes up an annular space around the collection receptacle and turns to pass through a bladed wheel that imparts a spin to the flowing stream. The flow direction reverses from up before the wheel to down through a tube after the wheel. The solids are flung to the tube periphery and the fluid reverses direction to go back up to a screen before reaching the eductor suction connection. The debris swirls down an open bottom tube and is collected in a housing surrounding the down tube.

22 Claims, 3 Drawing Sheets

CENTRIFUGAL SUBTERRANEAN DEBRIS COLLECTOR

FIELD OF THE INVENTION

The field of the invention is subterranean debris cleanup tools and more particularly the type of tools that direct debris with flow into the lower end of the tool and retain the debris in a collection volume around an inlet tube and most particularly also employ a swirling movement of the incoming debris laden stream to enhance separation in the tool.

BACKGROUND OF THE INVENTION

Milling operations at subterranean locations involve fluid circulation that is intended to remove cuttings to the surface. Some of these cuttings do not get transported to the surface and settle out on a wellbore support such as a packer or bridge plug that is below. In open hole situations the wellbore can collapse sending debris into the borehole. Over time sand and other debris can settle out on a borehole support and needs to be removed for access to the support or to allow further subterranean operations.

Wellbore cleanup tools have been used to remove such debris. Different styles have developed over time. In a traditional style the motive fluid goes through the center of the tool and out the bottom to fluidize the debris and send the debris laden stream around the outside of the tool where a diverter redirects flow through the tool body. A receptacle collects the debris as the clean fluid passes through a screen and is discharged above the diverter for the trip to the surface.

Another type of tool has a jet stream going downhole outside the tool to drive debris into the lower end of the tool where debris is collected and clean fluid that passes through a screen is returned to the surface outside the tool through ports located near the downhole oriented jet outlets. The jet outlets act as an eductor for pulling in debris laden flow into the lower end of the tool. Some examples of such tools are U.S. Pat. Nos. 6,176,311; 6,607,031; 7,779,901; 7,610,957; 7,472,745; 6,276,452; 5,123,489. Debris catchers with a circulation pattern that takes debris up on the outside of the tool body and routes it into the tool with a diverter are illustrated in U.S. Pat. Nos. 4,924,940; 6,189,617; 6,250,387 and 7,478,687.

The use of centrifugal force to separate components of different densities is illustrated in a product sold by Cavins of Houston, Tx. under the name Sandtrap Downhole Desander for use with electric submersible pump suction lines. U.S. Pat. No. 7,635,430 illustrates the use of a hydro-cyclone on a wellhead. Also relevant to the subterranean debris removal field is SPE 96440; P. Connel and D. B. Houghton; Removal of Debris from Deep Water Wellbore Using Vectored Annulus Cleaning System Reduces Problems and Saves Rig Time. Also relevant to the field of subterranean debris removal are U.S. Pat. Nos. 4,276,931 and 6,978,841.

Current designs of debris removal devices that take in the debris with fluid reverse circulating into the lower end of the tool housing have used a straight shot for the inlet tube coupled with a deflector at the top that can be a cone shape 10 as in FIG. 1 or a flat plate 12 as in FIG. 2. Arrow 14 represents the direction the solids need to go to be collected in the chamber 16 that is disposed around the inlet tube 18. One of the concerns of the FIGS. 1 and 2 designs is that a very long separation chamber that is between the cone 10 or the plate 12 and the outlet 20 is needed to separate the debris from the flowing fluid using gravity and the slowing for fluid velocity that occurs when the stream of debris laden fluid exits the inlet tube 18 and goes into the larger diameter of the housing 22 on the way to the outlet 20. After the outlet 20 there is a screen and what debris that does not fall out into the chamber 16 winds up putting a load on that screen above which impedes circulation and ability to pick up debris in the first place. Increasing the inlet velocity in an effort to entrain more debris into the tube 18 also winds up being counterproductive in the FIGS. 1 and 2 designs as the higher velocity after an exit from the tube 18 also causes higher turbulence and re-entrainment of the debris that would otherwise have been allowed to settle by gravity into the collection chamber 16. FIG. 3 illustrates the known VACS from Baker Hughes, a portion of which is shown in FIGS. 1 and 2. It also shows that the flow from exit 22 goes into a screen 23 and is then educted into a feed stream 25 from the surface. After the eductor exit 27 the flow splits with 29 going to the surface and 31 going to the bottom and into the inlet tube 18.

The present invention seeks to enhance the separation effect and do so in a smaller space and in a manner that can advantageously use higher velocities to enhance the separation. This is principally accomplished by inducing a swirl to the incoming debris laden fluid stream. A turbine wheel imparts the spiral pattern to the fluid stream so that the solids by centrifugal force are hurled to the outer periphery of a down flow tube before reversing and turning up on the way to the outlet of the housing and the downstream screen. These and other aspects of the present invention will be more readily apparent to those skilled in the art from a review of the description of the preferred embodiment and the associated drawings while understanding that the full scope of the invention is to be determined from the appended claims.

SUMMARY OF THE INVENTION

A subterranean debris catcher takes in debris laden fluid at a lower end. The inlet flow is induced with an eductor whose discharge goes around the housing to the lower end inlet for the debris. The eductor suction induces flow into the lower end of the housing as well. Incoming debris goes up an annular space around the collection receptacle and turns to pass through a bladed wheel that imparts a spin to the flowing stream. The flow direction reverses from up before the wheel to down through a tube after the wheel. The solids are flung to the tube periphery and the fluid reverses direction to go back up to a screen before reaching the eductor suction connection. The debris swirls down an open bottom tube and is collected in a housing surrounding the down tube.

DETAILED DESCRIPTION OF THE PREFERRED EMBODIMENT

Figure 1:
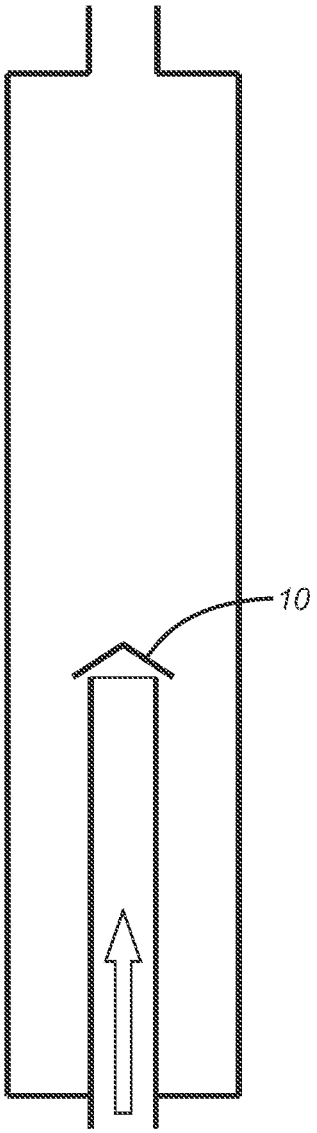
(PRIOR ART) FIG. 1
FIG. 1 is a prior art design of a debris removal tool taking in debris at a bottom location through an inlet tube with a cone-shaped cover on top.
Figure 2:
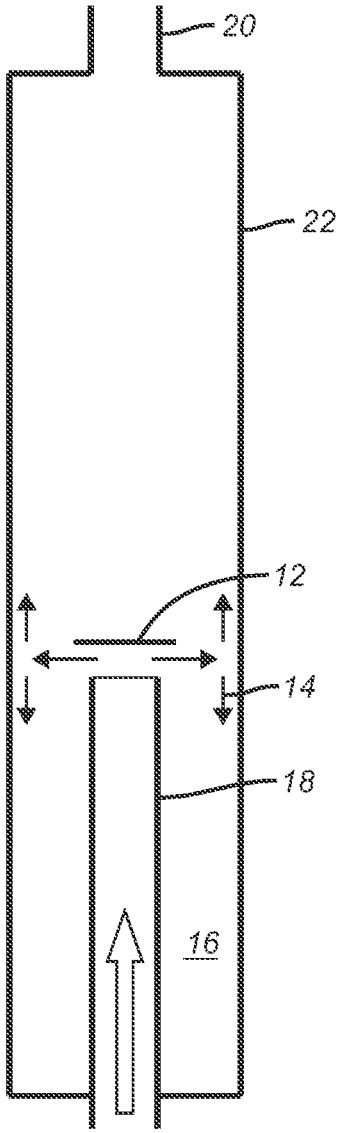
(PRIOR ART) FIG. 2
FIG. 2 is another prior art variation of FIG. 1 where a plate is located above the top outlet of the inlet tube.
Figure 3:
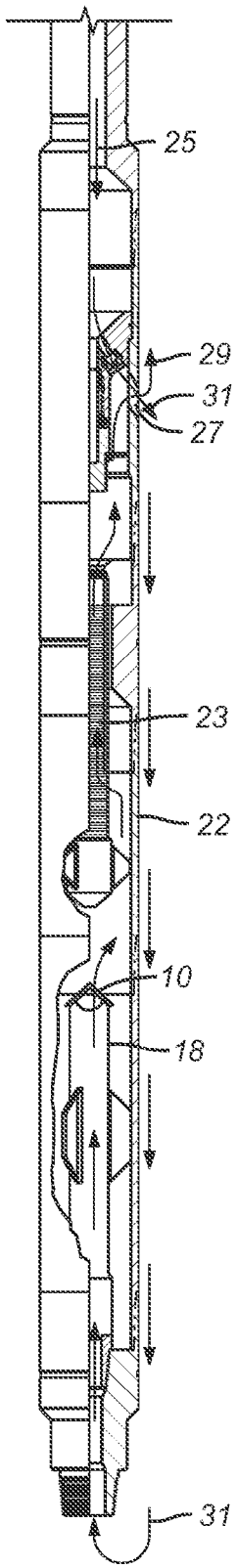
(PRIOR ART) FIG. 3
FIG. 3 is a section view of a prior art removal tool known as the VACS.
Figure 4:
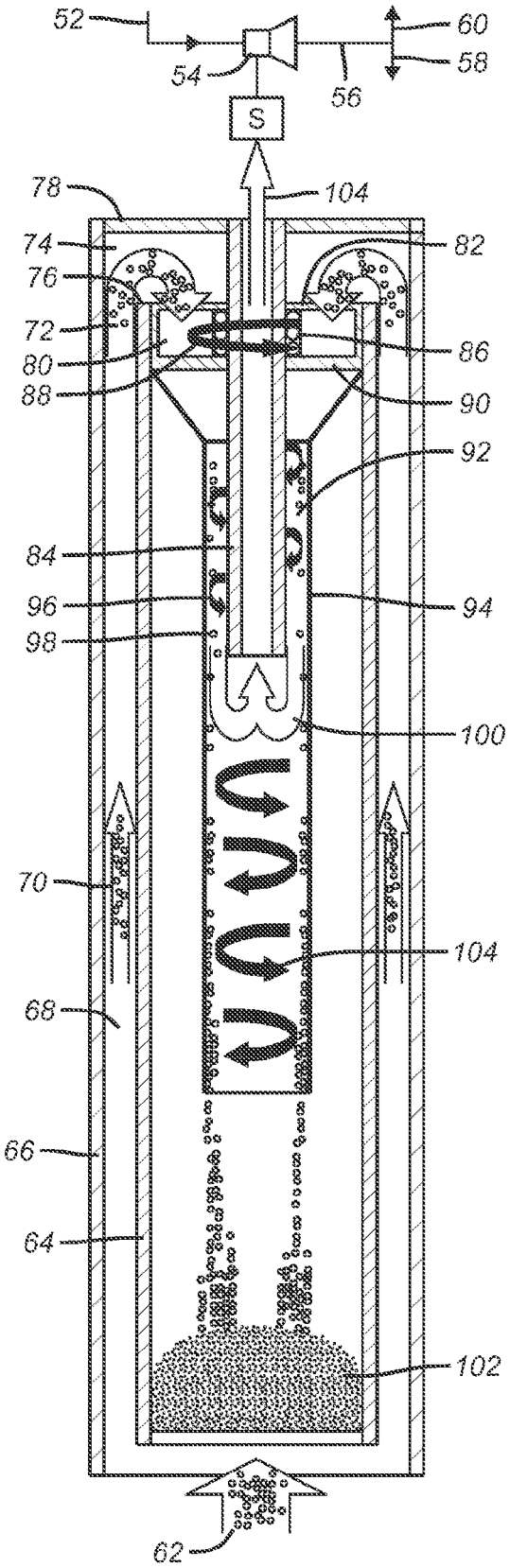
FIG. 4 is a section view of the debris removal tool of the present invention.

FIG. 4 is a part schematic representation of the debris collection apparatus 50 of the present invention. As in the past designs fluid is delivered from the surface under pressure at line 52 and into the eductor inlet 54. The eductor outlet 56 flow goes toward hole bottom at 58 and back to the surface at 60. The flow stream 58 picks up debris from milling or other local operations for ultimate retention in a collection housing 64 that sits inside an outer housing 66. The incoming debris flow 62 is the continuation of flow stream 58 that now has the debris entrained with it. After separation the fluid exit stream passes through screen S before reaching the eductor inlet 54. In the past, fine debris that did not get separated earlier wound up clogging the screen S and reducing the circulation rates. This had a detrimental effect on the ability to direct debris into the apparatus 50 at the inflow location of stream 62.

The manner in which the separation occurs in the housing 66 and the configuration of the internal components of housing 66 represents the departure from the previous designs. The incoming flow stream 62 brings in the debris and is channeled into an annular flow path 68 as represented by arrow 70. Flowing through the annular path 68 upon entry maintains the fluid velocity to keep the solids entrained on the way to the first direction reversal represented by arrow 72. The open volume 74 above the upper end 76 of the housing 64 allows for larger radius turns that reduce flow resistance and effects of erosion from entrained solids making a direction change. As an alternative the upper end 76 could extend to top cover 78 and instead have a port aligned with inlets 80 of a stationary turbine wheel 82. The wheel 82 is mounted over exit tube 84 and has a seal 86 in between. Alternatively to a fixed mounting that induces spin due to its shape the wheel assembly 82 can rotate on a sealed bearing as schematically represented by circular arrow 88. In that case the shroud 90 for the wheel assembly 82 is fixed to collection housing 64. The flow into inlets 80 spins the wheel 82 about a vertical axis. The flowing stream exits the wheel 82 with an imparted spin and heads down annular passage 92 formed between exit tube 84 and down tube 94. Curved arrow 96 illustrates how the solids 98 are propelled by centripetal force outwardly against the wall of down tube 94. The flowing stream finds its exit at the lower end of exit tube 84 and reverses direction again to go up the tube 84 as illustrated by arrow 100. The debris 98 due to its weight and the spinning action continues moving down to the bottom to form a collection pile 102. Arrow 105 represents the clean flow stream with hopefully a small quantity of fines that will either be small enough to pass screen S without damage to the eductor above or will be of such a small quantity that the debris collection job can be accomplished to the end without performance deterioration caused by impeded flow at screen S.

The design is focused at removal of more of the fine debris that in the past got carried up to the screen S. Part of that focus in the maintenance of velocity at entry using the annular space 68. Then there is the first direction reversal at open volume 74 leading right into the wheel 82 that in the preferred embodiment spins on its axis and accelerates the debris including the fines radially outwardly as the now spiraling flow stream continues down annular space 92 with the debris 98 rubbing on the wall of the tube 96 until landing in the pile 102 at the lower end of the chamber 64. Below the lower end of the exit tube 84 the fluid stream reverses direction to go up as indicated by arrow 100 and the debris that is moving down by gravity and spin as indicated by arrows 104 is now in a fairly quiescent zone with little turbulence to allow the debris 98 to continue on its spiral descent.

The apparatus 50 can be deployed in any orientation although the closer the orientation is to vertical the better the performance for removal of debris. For cleaning after removal from the subterranean location, the bottom 106 can be removed and the collected debris flushed out. The turbine wheel 82 preferably rotates in reaction to the passing flow. Rotation is preferred as the pressure drop for the flowing fluid is lower than in a static situation. However, the assembly will still impart a spin to the flowing fluid even if the wheel for any reason is jammed with debris or has a bearing failure. The advantage of the spinning flowing stream will still be there to aid in separation. As another alternative the mere number of direction reversals can also act as a separation technique to remove debris even without the spinning imparted by the use of the wheel 82. Clearly, adding the wheel and then allowing it to rotate represent an improvement over just relying on directional reversals. While reference is made to a wheel 82 that can resemble for example a closed impeller in a centrifugal pump or a turbine rotor, other structures that take an incoming stream and impart a spin to it are also contemplated. This can be as simple as a series of fixed or pivoting baffle plates or other shapes extending into a flow stream that impart rotation to the flow while not creating turbulence to the point of large pressure drops or velocities so high that erosion becomes an issue. Options to line impingement surfaces with hardened material can be deployed keeping in mind that space considerations may dictate the thickness of any such coating to protect the internal walls of the apparatus 50 from erosion from solids impingement.

The above description is illustrative of the preferred embodiment and many modifications may be made by those skilled in the art without departing from the invention whose scope is to be determined from the literal and equivalent scope of the claims below.

I claim:

1. A debris removal device for subterranean use operable to remove debris before production resumes using pumped fluid flow through a line that positions the debris removal device adjacent the debris for removal of debris with pumped flow into the debris removal device, comprising:

an outermost housing supported on a line for placement against the debris to be removed and delivery of pumped fluid to said housing, said housing further having an open ended annularly shaped inlet for placement in the debris to induce said debris to flow into said housing, said inlet located at a free end of said outermost housing so that said free end can be landed on the debris during operation and said housing further comprising an outlet;

an eductor to draw debris laden fluid into said inlet;

a debris collection chamber in said housing;

a fluid passage from said inlet to said outlet that reverses direction at least once between said inlet and said outlet while being open at a location between said inlet and outlet for debris to collect in said debris collection chamber;

said passage is defined by an open ended annular path between said debris collection chamber and said housing that begins at said inlet to direct debris laden flow in an opposite direction than removed debris that falls into said debris collection chamber.

2. The device of claim 1, wherein:

said reversal in direction comprises a u-turn.

3. The device of claim 2, wherein:

said passage makes at least two u-turns between said inlet and said outlet.

4. The device of claim 2, wherein:

said annular path extends over and into an open top of said debris collection chamber.

5. The device of claim 4, further comprising:

an inlet tube in said debris collection chamber that conducts fluid from said annular path and further into said debris collection chamber said inlet tube having open opposed ends.

6. The device of claim 5, wherein:

an outlet tube extending from said outlet and at least in part into said inlet tube and having opposed open ends.

7. The device of claim 6, further comprising:

a spin imparting device associated with said inlet tube to spin debris laden fluid stream against said inlet tube.

8. The device of claim 7, wherein:

said spin imparting device is rotationally mounted.

9. The device of claim 8, wherein:

said spin imparting device comprises a bladed wheel structure.

10. The device of claim 7, wherein:

said spin imparting device is movably mounted.

11. The device of claim 7, wherein:

said spin imparting device is stationary.

12. The device of claim 1, wherein:

a spin inducing member in said passage to impart spin to the fluid passing through said passage to aid in removal of debris into said debris collection chamber.

13. The device of claim 12, wherein:

said spin imparting device is rotationally mounted.

14. The device of claim 13, wherein:

said spin imparting device comprises a bladed wheel structure.

15. The device of claim 12, wherein:

said spin imparting device is movably mounted.

16. The device of claim 12, wherein:

said spin imparting device is stationary.

17. The device of claim 12, wherein:

said fluid passage from said inlet to said outlet reverses direction at least once between said inlet and said outlet.

18. The device of claim 17, wherein:

said reversal in direction comprises a u-turn.

19. The device of claim 18, wherein:

said passage makes at least two u-turns between said inlet and said outlet.

20. The device of claim 18, wherein:

said annular path extends over and into an open top of said debris collection chamber.

21. The device of claim 20, further comprising:

an inlet tube in said debris collection chamber that conducts fluid from said annular path and further into said debris collection chamber said inlet tube having open opposed ends.

22. The device of claim 21, wherein:

an outlet tube extending from said outlet and at least in part into said inlet tube and having opposed open ends.

* * * * *